US007771272B2

(12) United States Patent
Soltys et al.

(10) Patent No.: US 7,771,272 B2
(45) Date of Patent: Aug. 10, 2010

(54) SYSTEMS AND METHODS FOR MONITORING ACTIVITIES ON A GAMING TABLE

(75) Inventors: Richard Soltys, Mercer Island, WA (US); Richard Huizinga, Mercer Island, WA (US)

(73) Assignee: Bally Gaming, Inc., Las Vegas, NV (US)

( * ) Notice: Subject to any disclaimer, the term of this patent is extended or adjusted under 35 U.S.C. 154(b) by 1350 days.

(21) Appl. No.: 11/107,411

(22) Filed: Apr. 14, 2005

(65) Prior Publication Data

US 2005/0258597 A1 Nov. 24, 2005

Related U.S. Application Data

(60) Provisional application No. 60/562,772, filed on Apr. 15, 2004.

(51) Int. Cl.
*A63F 13/00* (2006.01)

(52) U.S. Cl. ..... 463/25; 463/46; 273/309

(58) Field of Classification Search ..... 463/12–13, 463/16, 25, 46; 273/138.1, 139, 292, 283, 273/287, 309, 138; 108/66, 152, 153.1
See application file for complete search history.

(56) References Cited

U.S. PATENT DOCUMENTS

| | | | | |
|---|---|---|---|---|
| 2,595,845 | A * | 5/1952 | Hagwell | 108/66 |
| 3,766,452 | A | 10/1973 | Burpee et al. | 317/262 R |
| 3,810,172 | A | 5/1974 | Burpee et al. | 343/5 PD |
| 4,026,309 | A | 5/1977 | Howard | 133/8 R |
| 4,531,187 | A | 7/1985 | Uhland | 364/412 |
| 4,636,846 | A | 1/1987 | Villarreal | 358/100 |
| 4,636,896 | A | 1/1987 | Takikawa | 360/105 |
| 4,656,463 | A | 4/1987 | Anders et al. | 340/572 |
| 4,693,480 | A | 9/1987 | Smith | 273/296 |
| 4,755,941 | A | 7/1988 | Bacchi | 364/412 |

(Continued)

FOREIGN PATENT DOCUMENTS

DE 44 39 502 C1 9/1995

(Continued)

OTHER PUBLICATIONS

Bravo Gaming Systems, "Casino Table Wager Analysis and Player Tracking System—Table Operations/Unique Features," accessed Apr. 11, 2005, URL = http://www.genesisgaming.com, 4 pages.

(Continued)

*Primary Examiner*—Dmitry Suhol
*Assistant Examiner*—Alex F. R. P. Rada, II
(74) *Attorney, Agent, or Firm*—Seed IP Law Group PLLC

(57) ABSTRACT

A gaming system includes a gaming table and a podium. The podium is located adjacent to a back portion of the gaming table and carries one or more optical readers. The readers are configured to read at least one wager placed approximately within a demarcated wagering area on a playing surface of the gaming table. The readers can be optical imagers, optical scanner, and/or video imagers. The podium and/or gaming table can carry a number of gaming automation components such as a card reader, a discard reader, chip tray, etc.

30 Claims, 8 Drawing Sheets

U.S. PATENT DOCUMENTS

| | | | | |
|---|---|---|---|---|
| 4,814,589 | A | 3/1989 | Storch et al. | 235/375 |
| 4,861,041 | A | 8/1989 | Jones et al. | 273/292 |
| 4,926,996 | A | 5/1990 | Eglise et al. | 194/212 |
| 5,007,641 | A | 4/1991 | Seidman | 273/138 A |
| 5,103,081 | A | 4/1992 | Fisher et al. | 235/464 |
| 5,166,502 | A | 11/1992 | Rendleman et al. | 235/492 |
| 5,216,234 | A | 6/1993 | Bell | 235/494 |
| 5,258,837 | A | 11/1993 | Gormley | 358/140 |
| 5,283,422 | A | 2/1994 | Storch et al. | 235/375 |
| 5,364,104 | A | 11/1994 | Jones et al. | 273/292 |
| 5,397,133 | A | 3/1995 | Penzias | 273/439 |
| 5,406,264 | A | 4/1995 | Plonsky et al. | 340/572 |
| 5,416,308 | A | 5/1995 | Hood et al. | 235/454 |
| 5,458,333 | A | 10/1995 | Takemoto et al. | 273/138 A |
| 5,586,936 | A * | 12/1996 | Bennett et al. | 463/25 |
| 5,605,334 | A | 2/1997 | McCrea, Jr. | 273/309 |
| 5,613,912 | A | 3/1997 | Slater | 463/25 |
| 5,645,486 | A | 7/1997 | Nagao et al. | 463/27 |
| 5,651,548 | A * | 7/1997 | French et al. | 463/25 |
| 5,676,376 | A | 10/1997 | Valley | 273/288 |
| 5,707,287 | A | 1/1998 | McCrea, Jr. | 463/27 |
| 5,735,525 | A | 4/1998 | McCrea, Jr. | 273/309 |
| 5,735,742 | A | 4/1998 | French | 463/25 |
| 5,742,656 | A | 4/1998 | Mikulak et al. | 377/7 |
| 5,755,618 | A | 5/1998 | Mothwurf | 453/17 |
| 5,757,876 | A | 5/1998 | Dam et al. | 377/7 |
| 5,770,533 | A | 6/1998 | Franchi | 463/42 |
| 5,781,647 | A | 7/1998 | Fishbine et al. | 382/1 |
| 5,785,321 | A | 7/1998 | van Putten et al. | 273/309 |
| 5,788,574 | A | 8/1998 | Ornstein et al. | 463/25 |
| 5,801,766 | A | 9/1998 | Alden | 348/157 |
| 5,803,808 | A | 9/1998 | Strisower | 463/11 |
| 5,809,482 | A | 9/1998 | Strisower | 705/30 |
| 5,831,669 | A | 11/1998 | Adrain | 348/143 |
| 5,842,921 | A | 12/1998 | Mindes et al. | 463/16 |
| 5,895,321 | A | 4/1999 | Gassies et al. | 463/29 |
| 5,909,876 | A | 6/1999 | Brown | 273/309 |
| 5,911,626 | A | 6/1999 | McCrea, Jr. | 463/27 |
| 5,919,090 | A | 7/1999 | Mothwurf | 463/25 |
| 5,931,731 | A | 8/1999 | Chwalisz | 453/32 |
| 5,936,527 | A | 8/1999 | Isaacman et al. | 340/572.1 |
| 5,941,769 | A | 8/1999 | Order | 463/12 |
| 5,957,776 | A | 9/1999 | Hoehne | 463/25 |
| 6,021,949 | A | 2/2000 | Boiron | 235/492 |
| 6,029,891 | A | 2/2000 | Freeman et al. | 235/380 |
| 6,032,955 | A | 3/2000 | Luciano et al. | 273/138.1 |
| 6,041,722 | A * | 3/2000 | Baker | 108/77 |
| 6,093,103 | A | 7/2000 | McCrea, Jr. | 463/27 |
| 6,117,012 | A | 9/2000 | McCrea, Jr. | 463/27 |
| 6,126,166 | A | 10/2000 | Lorson et al. | 273/148 R |
| 6,154,131 | A | 11/2000 | Jones, II et al. | 340/540 |
| 6,165,069 | A | 12/2000 | Sines et al. | 463/12 |
| 6,166,763 | A | 12/2000 | Rhodes et al. | 348/143 |
| 6,186,895 | B1 | 2/2001 | Oliver | 463/25 |
| 6,200,218 | B1 | 3/2001 | Lindsay | 463/25 |
| 6,217,447 | B1 | 4/2001 | Lofink et al. | 463/12 |
| 6,234,898 | B1 | 5/2001 | Belamant et al. | 463/25 |
| 6,254,484 | B1 | 7/2001 | McCrea, Jr. | 463/27 |
| 6,264,109 | B1 | 7/2001 | Chapet et al. | 235/492 |
| 6,267,671 | B1 | 7/2001 | Hogan | 463/25 |
| 6,283,856 | B1 | 9/2001 | Mothwurf | 463/17 |
| 6,299,534 | B1 | 10/2001 | Breeding et al. | 463/25 |
| 6,313,871 | B1 * | 11/2001 | Schubert | 348/143 |
| 6,346,044 | B1 | 2/2002 | McCrea, Jr. | 463/27 |
| 6,352,261 | B1 | 3/2002 | Brown | 273/288 |
| 6,425,817 | B1 | 7/2002 | Momemy | 453/17 |
| 6,446,864 | B1 | 9/2002 | Kim et al. | 235/382 |
| 6,457,715 | B1 | 10/2002 | Friedman | 273/274 |
| 6,460,848 | B1 | 10/2002 | Soltys et al. | 273/149 R |
| 6,464,584 | B2 | 10/2002 | Oliver | 463/25 |
| 6,503,147 | B1 | 1/2003 | Stockdale et al. | 463/29 |
| 6,508,709 | B1 | 1/2003 | Karmarkar | 463/42 |
| 6,514,140 | B1 * | 2/2003 | Storch | 463/25 |
| 6,517,435 | B2 | 2/2003 | Soltys et al. | 463/25 |
| 6,517,436 | B2 | 2/2003 | Soltys et al. | 463/29 |
| 6,517,437 | B1 | 2/2003 | Wells et al. | 463/30 |
| 6,520,857 | B2 | 2/2003 | Soltys et al. | 463/29 |
| 6,527,271 | B2 * | 3/2003 | Soltys et al. | 273/148 R |
| 6,530,836 | B2 | 3/2003 | Soltys et al. | 463/29 |
| 6,530,837 | B2 | 3/2003 | Soltys et al. | 463/29 |
| 6,532,297 | B1 | 3/2003 | Lindquist | 382/100 |
| 6,533,276 | B2 | 3/2003 | Soltys et al. | 273/148 R |
| 6,533,662 | B2 | 3/2003 | Soltys et al. | 463/25 |
| 6,567,159 | B1 | 5/2003 | Corech | 356/71 |
| 6,575,834 | B1 | 6/2003 | Lindo | 463/40 |
| 6,579,180 | B2 | 6/2003 | Soltys et al. | 463/25 |
| 6,579,181 | B2 | 6/2003 | Soltys et al. | 463/25 |
| 6,581,747 | B1 | 6/2003 | Charlier et al. | 194/214 |
| 6,595,857 | B2 | 7/2003 | Soltys et al. | 463/29 |
| 6,620,046 | B2 | 9/2003 | Rowe | 463/25 |
| 6,629,591 | B1 | 10/2003 | Griswold et al. | 194/205 |
| 6,629,889 | B2 | 10/2003 | Mothwurf | 463/25 |
| 6,638,161 | B2 | 10/2003 | Soltys et al. | 463/12 |
| 6,645,077 | B2 | 11/2003 | Rowe | 463/42 |
| 6,663,490 | B2 | 12/2003 | Soltys et al. | 463/25 |
| 6,685,564 | B2 | 2/2004 | Oliver | 463/25 |
| 6,688,979 | B2 | 2/2004 | Soltys et al. | 463/25 |
| 6,712,696 | B2 | 3/2004 | Soltys et al. | 463/25 |
| 6,726,099 | B2 | 4/2004 | Becker et al. | 235/380 |
| 6,729,956 | B2 | 5/2004 | Wolf et al. | 463/25 |
| 6,755,741 | B1 | 6/2004 | Rafaeli | 463/25 |
| 6,758,751 | B2 | 7/2004 | Soltys et al. | 463/29 |
| 6,848,994 | B1 | 2/2005 | Knust et al. | 463/25 |
| 7,005,985 | B1 | 2/2006 | Steeves | 340/572.1 |
| 7,029,009 | B2 | 4/2006 | Grauzer et al. | 273/149 P |
| 7,077,332 | B2 | 7/2006 | Verschuur et al. | 235/492 |
| 7,271,727 | B2 | 9/2007 | Steeves | 340/572.7 |
| 7,316,615 | B2 | 1/2008 | Soltys et al. | 463/25 |
| 7,404,765 | B2 | 7/2008 | Soltys et al. | 463/25 |
| 2001/0016515 | A1 | 8/2001 | Oliver | 463/25 |
| 2002/0084587 | A1 | 7/2002 | Bennett et al. | 273/309 |
| 2002/0147042 | A1 | 10/2002 | Vuong et al. | 463/40 |
| 2002/0187821 | A1 | 12/2002 | Soltys et al. | 463/11 |
| 2003/0022714 | A1 | 1/2003 | Oliver | 463/25 |
| 2003/0064774 | A1 | 4/2003 | Fujimoto et al. | 463/16 |
| 2003/0064798 | A1 | 4/2003 | Grauzer et al. | 463/29 |
| 2003/0195037 | A1 | 10/2003 | Vuong et al. | 463/29 |
| 2003/0212597 | A1 | 11/2003 | Ollins | 705/14 |
| 2003/0220136 | A1 | 11/2003 | Soltys et al. | 463/25 |
| 2004/0005920 | A1 | 1/2004 | Soltys et al. | 463/25 |
| 2004/0043820 | A1 | 3/2004 | Schlottmann | 463/43 |
| 2004/0087375 | A1 | 5/2004 | Gelinotte | 463/47 |
| 2004/0207156 | A1 | 10/2004 | Soltys et al. | 273/292 |
| 2004/0219982 | A1 | 11/2004 | Khoo et al. | 463/42 |
| 2004/0229682 | A1 | 11/2004 | Gelinotte | 463/25 |
| 2005/0026680 | A1 | 2/2005 | Gururajan | 463/25 |
| 2005/0051955 | A1 | 3/2005 | Schubert et al. | 273/149 R |
| 2005/0051965 | A1 | 3/2005 | Gururajan | 273/292 |
| 2005/0054408 | A1 | 3/2005 | Steil et al. | 463/11 |
| 2005/0059479 | A1 | 3/2005 | Soltys et al. | 463/29 |
| 2005/0062226 | A1 | 3/2005 | Schubert et al. | 273/149 R |
| 2005/0073102 | A1 | 4/2005 | Yoseloff et al. | 273/292 |
| 2005/0101367 | A1 | 5/2005 | Soltys et al. | 463/12 |
| 2005/0116020 | A1 | 6/2005 | Smolucha et al. | 235/375 |
| 2005/0164761 | A1 | 7/2005 | Tain | 463/13 |
| 2005/0236771 | A1 | 10/2005 | Soltys et al. | 273/274 |
| 2005/0258597 | A1 | 11/2005 | Soltys et al. | 273/274 |
| 2005/0288083 | A1 | 12/2005 | Downs, III | 463/11 |
| 2005/0288084 | A1 | 12/2005 | Schubert | 463/11 |
| 2005/0288085 | A1 | 12/2005 | Schubert et al. | 463/11 |
| 2006/0019739 | A1 | 1/2006 | Soltys et al. | 273/292 |
| 2007/0243927 | A1 | 10/2007 | Soltys | 463/25 |
| 2008/0076536 | A1 | 3/2008 | Shayesteh | 463/25 |
| 2009/0115133 | A1 | 5/2009 | Kelly et al. | 273/274 |

| | | | | |
|---|---|---|---|---|
| 2009/0117994 | A1 | 5/2009 | Kelly et al. | 463/25 |
| 2009/0118001 | A1 | 5/2009 | Kelly et al. | 463/29 |
| 2009/0118005 | A1 | 5/2009 | Kelly et al. | 463/31 |
| 2009/0118006 | A1 | 5/2009 | Kelly et al. | 463/31 |

FOREIGN PATENT DOCUMENTS

| | | | |
|---|---|---|---|
| DE | 197 48 930 | A1 | 5/1998 |
| EP | 0 327 069 | A2 | 8/1989 |
| EP | 0 790 848 | | 8/1997 |
| FR | 2 775 196 | | 8/1999 |
| GB | 2 382 034 | A | 5/2003 |
| WO | WO 96/03188 | | 2/1996 |
| WO | WO 96/36253 | | 11/1996 |
| WO | WO 97/13227 | | 4/1997 |
| WO | WO 00/22585 | | 4/2000 |
| WO | WO 02/05914 | A1 | 1/2002 |
| WO | WO 03/060846 | A2 | 7/2003 |
| WO | WO 2004/021294 | A1 | 3/2004 |

OTHER PUBLICATIONS

Bulavsky, J., "Tracking the Tables," *Casino Journal*, pp. 44-47, May 2004.
U.S. Appl. No. 11/030,609, filed Jan. 5, 2005, Soltys et al.
U.S. Appl. No. 11/408,862, filed Apr. 21, 2006, Soltys et al.
U.S. Appl. No. 11/437,590, filed May 19, 2006, Soltys et al.
U.S. Appl. No. 11/479,988, filed Jun. 30, 2006, Shayesteh.
U.S. Appl. No. 11/480,274, filed Jun. 30, 2006, Huizinga.
U.S. Appl. No. 11/519,244, filed Sep. 11, 2006, Soltys et al.
U.S. Appl. No. 60/544,090, filed Mar. 17, 2004, Soltys et al.
U.S. Appl. No. 60/838,280, filed Aug. 17, 2006, Soltys et al.
U.S. Appl. No. 60/847,331, filed Sep. 26, 2006, Shayesteh.
Burke, A., "Tracking the Tables," reprinted from *International Gaming & Wagering Business*, Aug. 2003, 4 pages.
Griffin, P., *The Theory of Blackjack*, GBC Press, Las Vegas, Nevada, 1979, 190 pages.
Gros, R., "All You Ever Wanted to Know About Table Games," reprinted from *Global Gaming Business*, Aug. 1, 2003, 2 pages.
Pro, L.V., ."Book Review—The Card Counter's Guide to Casino Surveillance," *Blackjack Insider Newsletter*, May 2003, #40, accessed Aug. 25, 2006, URL= http:/bjinsider.com/newsletter_40_surveillance.shtml, 5 pages.
Snyder, A., "The High-Tech Eye," excerpt from *Blackjack Forum*, Spring 1997, accessed Dec. 21, 2005, from Casino Software & Services, LLC, URL = http://www.casinosoftware.com/bj_forum.html.
Terdiman, D., "Who's Holding the Aces Now?", reprinted from *Wired News*, Aug. 18, 2003, 2 pages.
Ward, K., "BJ Tracking System has Players Down for the Count," *Gaming Today*, Mar. 5, 2002, accessed Dec. 21, 2005, from Casino Software & Services, LLC, URL = http://www.casinosoftware.com/gaming_today.html.
Winkler, C., "Product Spotlight: MindPlay," reprinted from *Gaming and Leisure Technology*, Fall 2003, 2 pages.
Bally TMS, "MP21—Automated Table Tracking/Features," 2 pages, Nov. 2005.
Bally TMS, "MPLite—Table Management System/Features," 2 pages, Nov. 2005.
Casino Software & Services, LLC., accessed Aug. 25, 2006, URL = http:/casinosoftware.com/home.html, 6 pages.
*Gambling Magazine*, "Gaming Company Takes RFID to the Casino," Dec. 27, 2004, accessed Aug. 25, 2006, URL = http:/www.gamblingmagazine.com/managearticle.asp?C=290&A=13186, 4 pages.
International Guild of Hospitality & Restaurant Managers, "Shuffle Master, Inc. (NasdaqNM:SHFL)," accessed Dec. 30, 2003, URL = http://hospitalityguide.com/Financial/Casinos/Shuffle.htm, 3 pages.
Mikohn, "Mikohn Tablelink—The Industry's Premier Table Tracking Solution Delivers Improvements Straight to the Bottom Line," 2 pages, before Jan. 1, 2004.
Mikohn, "Tablelink™, The New Standard in Table Games," before Jan. 1, 2004, 14 pages.
Shuffle Master, Inc., "Shuffle Master Announces New Products; Intelligent Table System to Be Debuted at G2E," Sep. 10, 2003, 2 pages.
Shuffle Master, Inc., "Shuffle Master Gaming Presents The Ultimate Player Rating System . . . Bloodhound Sniffs Out the Pros and Cons," Dec. 31, 1997, 6 pages.
English Translation of German Patent No. DE 197 48 930, publication dated of May 14, 1998, inventor: Markeev.
U.S. Appl. No. 60/887,092, filed Jan. 29, 2007, Shayesteh.
US 6,599,191, 07/2003, Breeding et al. (withdrawn)

* cited by examiner

SYSTEMS AND METHODS FOR MONITORING ACTIVITIES ON A GAMING TABLE

CROSS-REFERENCES TO RELATED APPLICATION

This application claims the benefit of U.S. Provisional Patent Application No. 60/562,772 filed on Apr. 15, 2004, which is incorporated herein by reference in its entirety.

BACKGROUND OF THE INVENTION

1. Field of the Invention

This description generally relates to the field of wagering or gaming, and more particularly to monitoring the wagers, cards, or other activities of players at a gaming table.

2. Description of the Related Art

Gaming has enjoyed phenomenal growth over the recent past, with the addition of numerous forms of wager based gaming, the legalization of wagering in a large number of jurisdictions domestically and internationally, and the construction of numerous casinos to service the increasing demand for gaming opportunities.

Casinos provide a large variety of games and other forms of entertainment of its customers. For example, casinos may provide slot machines, as well as, table games such as blackjack, poker, craps, roulette, baccarat, big wheel or wheel of fortune, to name a few. Due to the large amounts of money, particularly cash involved in gaming, casinos must carefully monitor the activities of both players and casino employees. Careful and continuous monitoring of gaming activities not only enhances security, but also permits the management to better manage the casinos' business, for example, selecting the number of mix of tables, the hours of operation of various tables, staffing, etc.

Typically, a customer exchanges currency or some form of credit for a casino's chips. The customer places the chips as wagers at various games, such as blackjack, craps, roulette, and baccarat. A game operator, such as a dealer, pays out winning wagers with additional chips based on the set of odds for the particular game. The dealer collects the customer's chips for losing wagers. The odds of each game slightly favor the casino, so on average the casino wins and is profitable.

Like many businesses, casinos wish to understand the habits of their customers. Some casinos have employees visually observe customer's game play, manually tracking the gaming and wagering habits of the particular customers. The information allows the casinos to select the number of different games that the casino will provide and to adequately staff those games.

The fast pace and large sums of money make casinos likely targets for cheating and stealing. Casinos employ a variety of security measures to discourage cheating or stealing by both customers and employees. For example, surveillance cameras covering a gaming area or particular gaming table provide a live or taped video signal that security personnel can closely examine. Additionally, or alternatively, "pit managers" can visually monitor the live play of a game at the gaming table.

While some aspects of a casino's security system should be plainly visible as a deterrent, other aspects of the security should be unobtrusive to avoid detracting from the players' enjoyment of the game and to prevent cheaters and thieves from avoiding detection.

The current methods of tracking have several drawbacks. The methods typically depend on manual observation of a gaming table. Thus coverage is not comprehensive, and is limited to tracking a relatively small number of games, customer's and employees. This problem is exacerbated by a customer's ability to rapidly move between gaming tables. A commonly known method for cheating customers to avoid detection is to switch tables frequently. The tracking methods are also prone to error since the manual methods rely on human observers who can become inattentive or distracted. In one commonly known method of cheating the casino, one member of a team will create a distraction while another member steals chips or swaps cards. These manual tracking methods are also labor intensive, and thus costly.

The monitoring of a player's wagers with video cameras placed somewhere with in the perimeter of the table also has several drawbacks. For example, the resolution of video images can be adversely effected by changes in lighting conditions, which may be caused by shadows cast on the table, smoke in the casino, or a variety of other reasons. The players and/or dealer may impede or block the line of sight of the imagers with their hands, clothing, or other items. In addition, some casinos prefer to keep records of each gaming day for some time. Because large quantities of computing memory are necessary to store video images, the video images from a given evening or week must be frequently overwritten.

Optical imagers located in a raised platform proximate to the player's seating positions is another arrangement that has been used to read chips on a gaming table during game play. The raised platform is raised slightly above the playing surface of the gaming table. A number of optical imagers or cameras and a number of illuminating lights are recessed or embedded in the raised platform and directed toward the playing surface. The raised platform has a dual purpose in that it functions as a railing or rim of the gaming table where players can lean, place beverages, etc. and also functions as a place to conceal the imagers and lights from the player's view.

There are several drawbacks to placing the optical imagers in the raised platform as described above. First, the imagers and the related optical components are susceptible to damage from spilled or leaky beverages. Second, the imagers are susceptible to interference from the players' hands, clothing, and/or personal items such as a purse. Lastly, the platform functions as a surface for the players to lean against and/or on, which may cause movement of the raised platform and which may then result in the imagers becoming misaligned relative to an area on the table that is to be imaged. To minimize movement of the raised platform relative to the gaming table, the platform should be securely connected to the table. This secure connection, however, makes it more time-consuming and difficult to perform maintenance on the imagers, replace the imagers, and/or replace the raised platform without disturbing the players and/or halting game play.

Another tracking option is to embed optical imagers in close proximity to the wagering area, the area where a player places his or her chips when making a wager. Close proximity to the wagering area is necessary to obtain sufficient resolution of the player's chips. However, placing optical imagers on the table surface detracts from the traditional look and feel of a gaming table. In addition, any protuberance in the table caused by the optical imagers creates an impediment the smooth flow of cards between the dealer and the players.

SUMMARY OF THE INVENTION

In one aspect, a gaming table includes a playing surface on which a card game may be played, the playing surface having a front portion about which a number of player positions are generally distributed and a back portion generally opposed across the playing surface from the front portion, the playing surface bearing a number of wagering areas corresponding to at least the number of player positions; a dealer podium spaced behind the back portion of the playing surface; and a reader carried by the dealer podium, the reader having at least one field of view extending generally toward at least one of the wagering areas.

In another aspect, a gaming table includes a front portion having number of player positions distributed adjacently thereto; a back portion to permit casino access to the gaming table; a playing surface on which a card game may be played, the playing surface disposed within a region defined by the front portion and the back portion, the playing surface bearing a number of wagering areas that correspond to the number of player positions; at least a portion of a dealer podium spaced behind the back portion of the gaming table; and a reader carried by the dealer podium, the reader configured to read at least one wager placed approximately within at least one of the number of wagering areas.

In yet another aspect, a gaming table includes playing surface means for supporting at least one wager, the playing surface means disposed generally between a front portion and a back portion of the gaming table, the front portion having a number of player positions generally distributed adjacently thereabout; optical reading means for reading the at least one wager on the playing surface means; and means for carrying the optical reading means, the means for carrying located behind the back portion of the gaming table.

DETAILED DESCRIPTION OF THE INVENTION

In the following description, certain specific details are set forth in order to provide a thorough understanding of various embodiments of the invention. However, one skilled in the art will understand that the invention may be practiced without these details. In other instances, well-known structures associated with computers, computer networks, readers and machine-vision have not been shown or described in detail to avoid unnecessarily obscuring descriptions of the embodiments of the invention.

The headings provided herein are for convenience only and do not interpret the scope or meaning of the claimed invention.

This description initially presents a general explanation of gaming and gaming table monitoring components in the environment of a blackjack table. While blackjack is used as an example, the teachings herein are generally applicable to a variety of wagering games, such as craps, baccarat, poker, wheel of fortune, and roulette to name only a few. A more specific description of each of the individual hardware components and the interaction of the hardware components follows. A description of the overall operation of the system follows the hardware discussion.

Blackjack Gaming Environment With Automated Features

Figure 1:
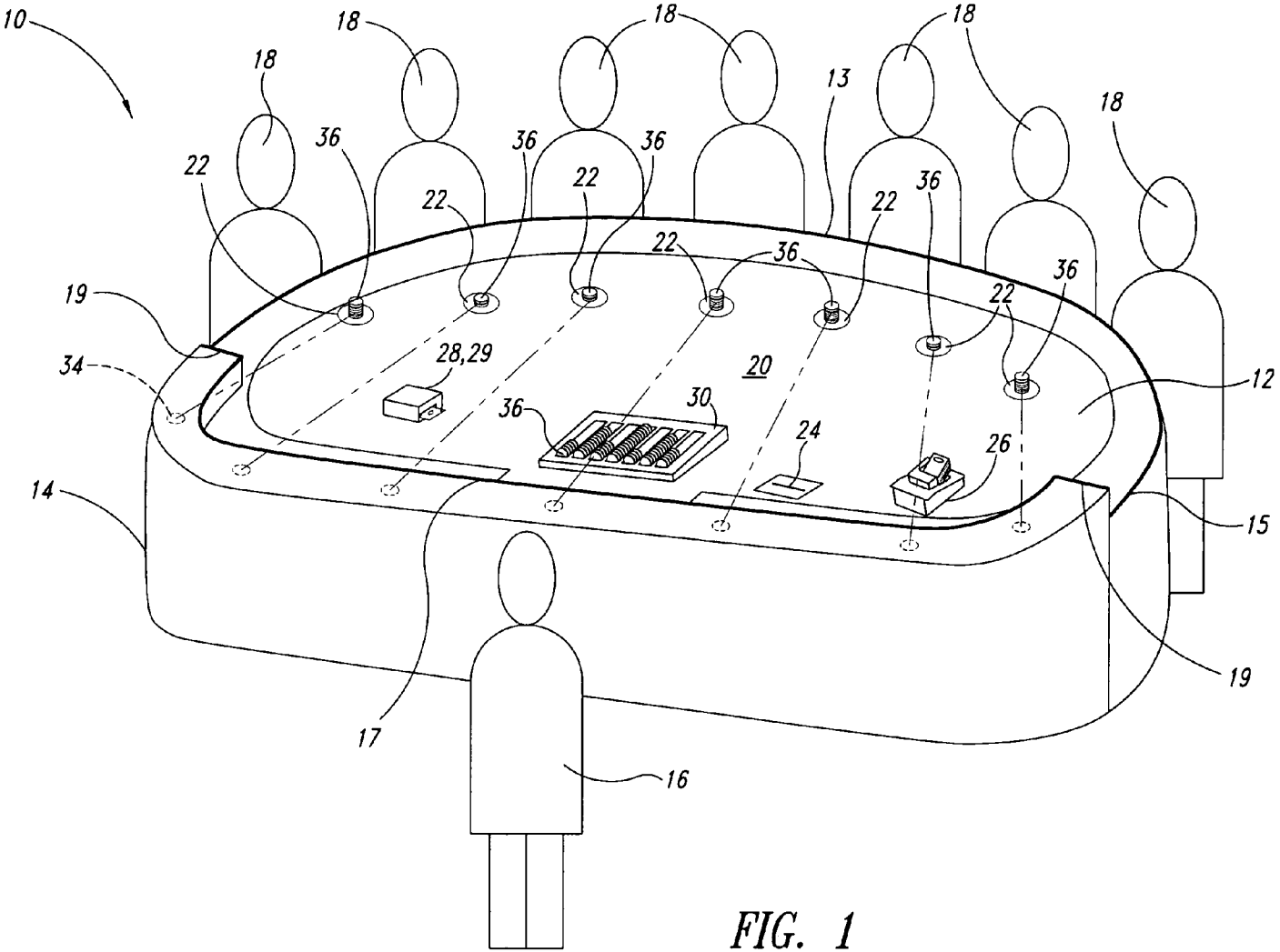
FIG. 1 is a top, rear, left side isometric view of a gaming environment where a dealer and players play a game at a gaming table according to one illustrated embodiment.

FIG. 1 illustrates one embodiment of a gaming environment 10 where a game of blackjack is played at a gaming table 12 by a game operator/dealer 16 and customers/players 18. A unit or dealer's podium 14is abutted to or attached to the gaming table 12. The podium 14 includes a number of optical readers to read wagers placed on the gaming table 12 according to the illustrated embodiment.

The gaming table 12 includes a useable playing surface 20, a front portion 15 disposed between two ends (identified by the darkened line adjacent to the player's 18), and a back portion 17 disposed between two ends (identified by the darkened line at the rear of the table 12). A number of player positions 18 are generally distributed about and adjacent to the front portion 15 of the playing table 12. The back portion 17 is generally opposed from the front portion 15 across the playing surface 20. The back portion permits access to the gaming table 12 by a casino employee, for example a blackjack or poker dealer. The back portion ends, can intersect or be proximately located with respect to front portion ends and thus define a perimeter 15, 17 that incorporates a useable and playing portion of the gaming table 12. The back portion 17 can take a variety of shapes and/or profiles. For example, the back portion 17 can be straight, as illustrated in FIG. 1, or the back portion 17 be curved, stepped, or some combination thereof.

The gaming table 12 can have a padded rim or rail 13, which gives the players 18 a place to lean or rest their elbows. The padded rail 13 is placed on the playing surface 20. An edge or surface of the padded rail 13 may extend beyond or be contemporaneous with the front portion 15 of the table 12.

The playing surface 20 typically comprises a felt-type cover 20 carrying symbols 22. The symbols 22 demarcate and/or identify areas on the table that have special purposes. For example, on the blackjack table 12, there are typically seven to nine player positions 18, each position associated with a respective wagering area or betting circle 22 demarcated on the cover 20. Gaming tables 12 for games other than blackjack may also have wagering areas 22 printed or otherwise carried on the cover 20. Although the wagering areas 22 are illustrated as circles in FIG. 1, it is understood that the wagering areas 22 may take a variety of shapes, such as a half circle, closed circle, square, rectangle, etc. A gaming table surface or cover 20 having pre-printed wagering areas that can be aligned with optical reading devices is described in detail in U.S. Provisional Patent Application No. 60/517,297.

To complete the gaming environment 10, various gaming related items can be carried by the table 12 and/or the podium 14. For example, a drop box 24, a discard reader 26, a card shoe 28 or card shoe reader 29, and a chip tray 30 containing a number of gaming chips 36 are carried on the useable playing surface 20 of the gaming table 12. These items, either singularly or in some combination, are used to automate and/or otherwise enhance the gaming environment 10.

The drop box 24 is used by the dealer 16 uses to securely store currency or other items that have been exchanged for gaming chips 36. The discard reader 26 is configured to read, scan, or image cards discarded by the players 18 during the game and at the conclusion of each game, which is described in more detail in U.S. Pat. Nos. 6,460,848, 6,652,379, and 6,685,568.

The card-dispensing device 28/29 houses one or more decks of cards, usually up to eight decks. The cards within the card-dispensing device 28/29 are typically removed one at a time. One type of card-dispensing device 28 is a non-automated card shoe 28. Card shoes 28 are generally loaded in a back room of the casino and brought to the individual gaming tables by a casino employee. Within the card shoe 28, a slanted ramp urges the cards toward a slotted opening and permits the cards to be easily drawn from the card shoe 28. The dealer 16 can individually draw the cards from the card shoe 28, or can remove an entire deck of cards from the card shoe 28 to deal by hand. Many players 18 appreciate the experience of a game where the cards are dealt from a deck held by the dealer 16, rather than being individually drawn from the card shoe 28.

An automated card-dispensing device 29 is typically referred to as a card shoe "reader" 29. The card shoe reader 29 can optically read (e.g., optically image, scan, or magnetically scan) at least some of the cards placed within the card shoe reader 29. The optical components of such a reader 29 are typically located under a transparent ramp within the card shoe reader 29. The ramp causes an edge portion of each card in the reader 29 to be exposed to the optical components, and thus to eventually be optically read. A card shoe reader 29 for automating a gaming table is described in detail U.S. Pat. No. 6,460,848, U.S. Provisional Patent Application Nos. 60/500,898, 60/501,489, and 60/511,931.

A casino computing system, discussed in more detail below, communicates with the card shoe reader 29, the discard reader 26, and/or other devices, to automate a gaming table 12 according to one embodiment. In addition, any one of the aforementioned devices can be located, integrated, recessed into, attached to, supported by, or otherwise connected to the gaming table 12 and/or the podium 14.

Chips

Figure 2A:
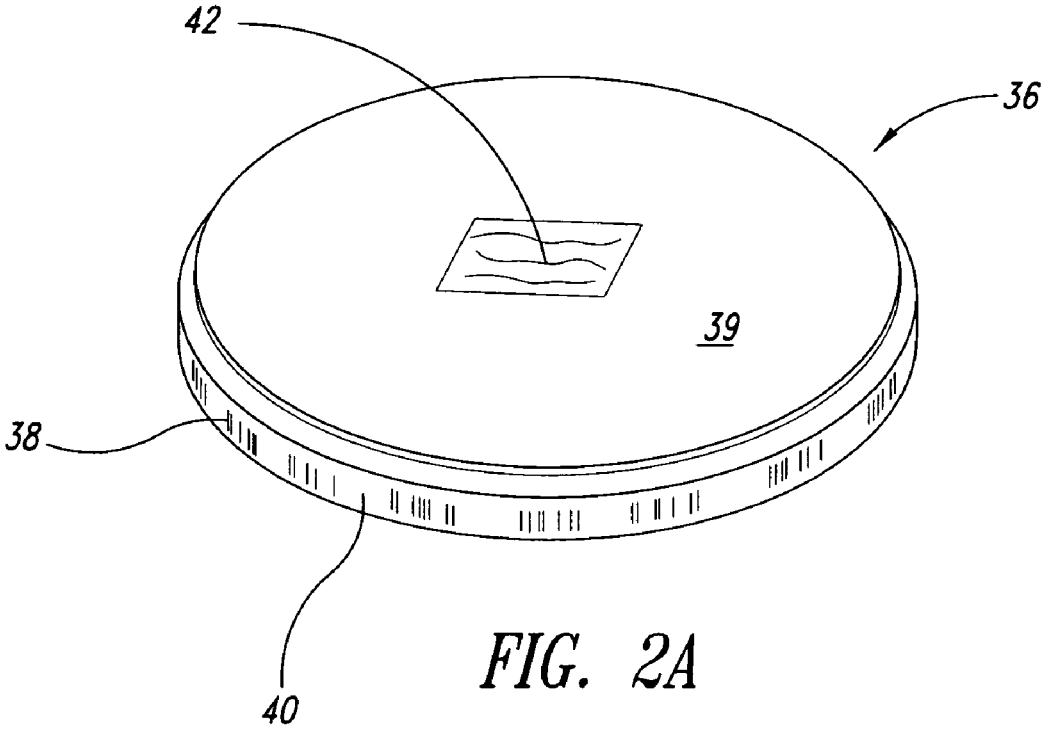
FIG. 2A is a top, front isometric view of a gaming chip with a machine-readable symbol according to one illustrated embodiment.
Figure 2B:
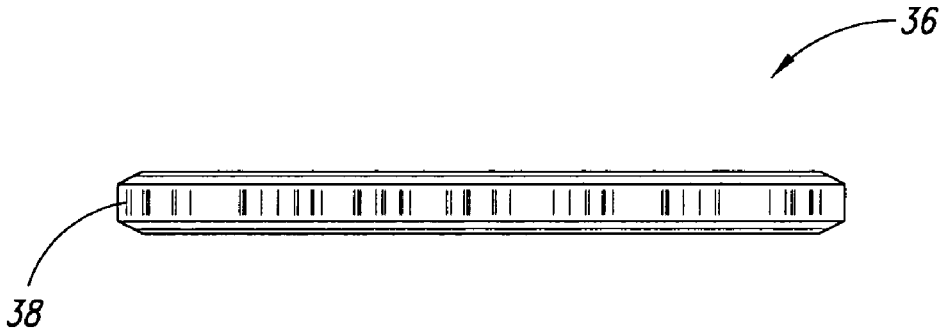
FIG. 2B is a front elevational view of the gaming chip of FIG. 2A.

FIGS. 2A and 2B show a gaming chip 36 having a disk shape. The gaming chip 36 could be any of a variety of denominations (i.e., the money equivalent value of the chip 36). In one embodiment, color and/or numeric markings 42 on the face 39 of the chip 36 visually depict the value of the chip 36. The gaming chip 36 can also include encoded information in the form of a machine-readable symbol or indicia 38, which can be located on the circumferential edge 40 of the chip 36. Additionally or alternatively, information can also be located on the upper surface 39, lower surface, or both and can be machine-readable or human readable. For example, the information can identify the issuing casino, the denomination, and/or a unique serial number of the chip 36. The machine-readable indicia 38 can be a bar code, an area or matrix code, a stacked code, and/or some other type of machine-readable or human-readable code.

While visually shown in FIGS. 2A and 2B, the machine-readable indicia 38 can be printed using ink that is not typically visible to humans, such as ink that is visible only in the infrared portion of the electromagnetic spectrum. Because it is desirable to optically read the chip 36, it may be advantageous if at least certain portions of the chip 36 have diffuse reflectance characteristics, such as the portion of the chip 36 having the machine-readable indicia 38. A surface with diffuse reflectance characteristics causes light to be reflected in all directions, which can make it easer for an optical reader to detect at least some of the light reflected from the chip 36. In contrast to diffuse reflectance characteristics, specular reflectance characteristics cause light to reflect from a surface at a specific angle to the surface. U.S. Pat. No. 5,103,081 to Fisher et al., U.S. Pat. No. 6,313,871, to Schubert, disclose systems for capturing video images of gaming chips, which may have encoded information. U.S. Pat. No. 6,514,140 to Storch, discloses systems for capturing still images of gaming chips, where the cameras are located in turrets on the gaming table surface and in close proximity to the wagering areas on the gaming table.

At least one method of making and encoding uniquely identifiable gaming chips 36 is described in detail in U.S. Provisional Patent Application No. 60/490,072. In one embodiment, the machine-readable symbol 38 on the chips 36 includes information about the denomination of the chip 36, at a minimum.

System Overview

Figure 3:
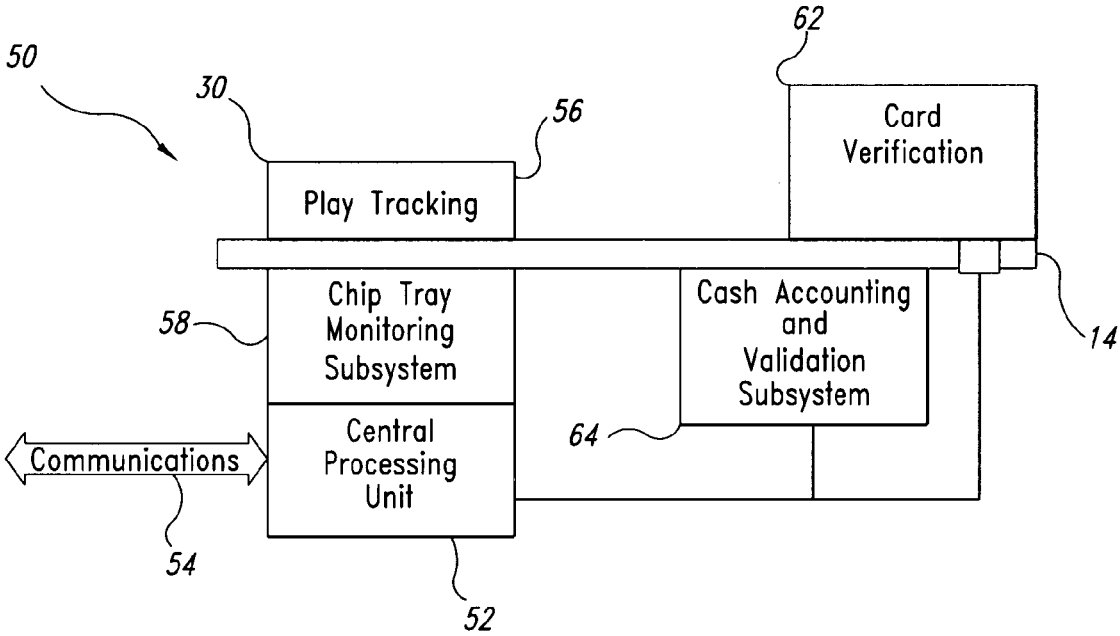
FIG. 3 is a block diagram of a monitoring system for monitoring the gaming environment of FIG. 1 according to one illustrated embodiment.

As shown in FIG. 3, a monitoring system 50 is provided for tracking the wagering and play at a gaming table 12. The monitoring system 50 includes a number of component subsystems coupled together by a central processing unit ("CPU") 52. The gaming table CPU 52 can take the form of a programmed general purpose computer, and/or a specialized dedicated processor card. The gaming table CPU 52, typically includes a processor, memory, multiplex ("Mux") card, video and Ethernet cards, power supply and an image acquisition card. While FIG. 3 shows a single centralized gaming table CPU 52, the monitoring system 50 can take a more distributed approach, locating dedicated processors in one or more of the individual system components. Alternatively, a common CPU could service a number of gaming tables, each of the gaming tables having a set of individual component subsystems. The gaming table CPU 52 communicates with external computers and devices over a communications link 54 such as a local area network ("LAN") and/or a wide area network ("WAN"). The communications link 54 can be wired and/or wireless. The communications link can employ Internet, or World Wide Web communications protocols, and can take the form of a proprietary extranet.

A play tracking subsystem 56 visually monitors activity on the playing surface 20 of the gaming table 12. In the illustrated embodiment, the play tracking subsystem 56 is located in the chip tray 30 and carried by the podium 14.

A chip tray monitoring subsystem 58 scans the machine-readable indicia 38 on the circumference of the chips 36 located therein. The chip tray monitoring system 58 is an integral component of the chip tray 30 according to one embodiment. The chip tray monitoring subsystem 58 is embedded or recessed in the podium 14 and removably attachable to the chip tray 30. One type of a chip tray for reading, imaging, or scanning chips located therein is described in detail in U.S. Pat. No. 6,712,696.

The overall system can be completed, at the casino's option, with a card verification subsystem 62, which is the optical hardware and/or software that reads at least some of the cards in the card shoe reader 29. The optical hardware can be integrally assembled with an independent card shoe reader 29, can be recessed in the table 12 and configured to be attachable to a card shoe 28, or recessed in the podium 14.

Various assemblies and embodiments of card-dispensing devices 28/29 are described in detail in U.S. Provisional Patent Application No. 60/511,931. Finally, the system can have a cash accounting and validation subsystem 64, which monitors the contents of the drop box 24 (FIG. 1).

Monitoring Gaming Chips

Still using the game of blackjack for illustration purposes, the players 18 place their respective wagers 36 by placing a number of gaming chips 36 in the wagering areas 22. Casinos usually require players 18 to use gaming chips 36 purchased from the casino's tellers or dealer 16 instead of using currency or credit at the gaming table 12.

At the end of a "hand" or game, the dealer 16 collects the wagered gaming chips 36 from losing players and pays out winnings in chips 36 to the winning players. The collected gaming chips 36 taken from the losing players are placed into a "bank" on the table. In one embodiment, the "bank" is the chip tray 30. The dealer 16 pays out the winnings using the required number of chips 36 from the chip tray 30. The chip tray 30 generally consists of a number of wells, sized to receive the gaming chips 36 with different wells generally used to contain different chip denominations. Changes to the contents of the chip tray 30 represent the winnings and losses of the casino ("house") at the gaming table 12. Thus, maintaining an accurate count of the number and value of the chips 36 in the chip tray 30 can assist the casino in managing its operations. Periodically, for example at the end of a dealer's shift, the contents of the drop box 24 must be reconciled with contents of the chip tray 30, to ascertain that the correct number and value of chips were distributed.

One way for casinos to more accurately track the gaming chips 36 being wagered and exchanged at the gaming table is for the casino to periodically survey the wagers on the table 12, the chips 36 located in the chip tray 30, and/or both. The player's wager may be a single chip 36, two or more chips 36, or even several stacks of chips 36. Casinos typically request that the players place their multiple chips in a stack 36 or stacks (not shown) before moving the wagered chips 36 into proximity of one of the wagering areas 22.

The discussion of the present invention herein involves several embodiments for optically reading information on chips 36 after the chips 36 have been placed on the gaming table 12 during a game. One purpose for automating the monitoring of the gaming environment is to augment the casino's manual security measures so that the casino can determine whether a certain player may be improperly increasing or decreasing his or her wager as the game progresses. Another advantage is to notify the casino whether more gaming chips 36 need to be placed into circulation on the casino floor, especially during peak gaming times.

Yet another advantage of automating the gaming environment 10 is to track wagering patterns of players to ascertain whether the player may be card counting or partaking in some other undesired activity. For example, a player that consistently makes low or minimum wagers when a certain number of cards remain in the deck indicates that the player is invoking some sort of card counting strategy. Additionally or alternatively, automating the monitoring of the gaming environment 10 provides the casino with information to compensate ("comp") players based on their duration of play, average value of their wagers, etc.

Podium Having Optical Detectors

Figure 4:
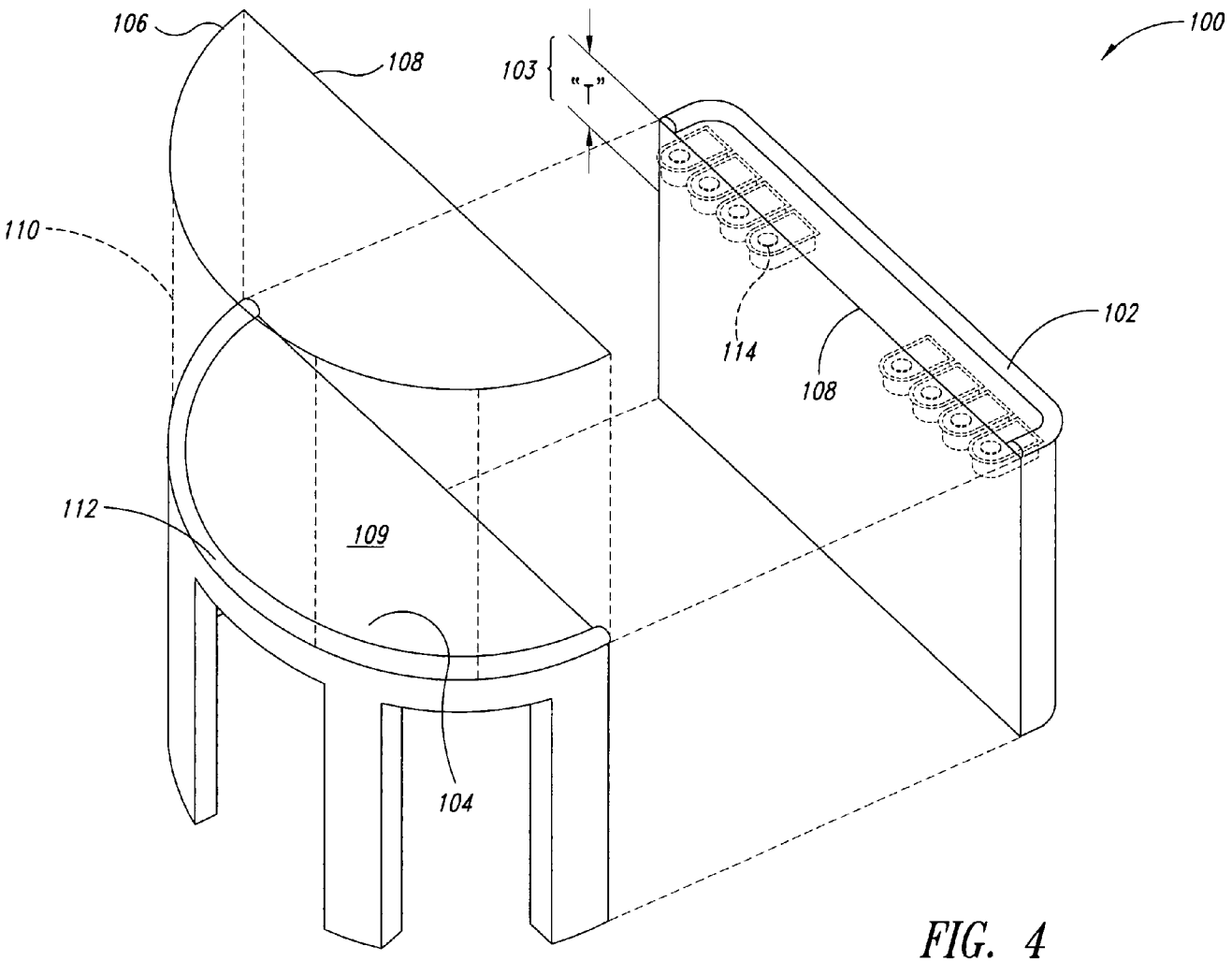
FIG. 4 is a top, front, right side, exploded isometric view of a gaming table having a podium located behind a back portion of the gaming table according to one illustrated embodiment.

FIG. 4 shows a gaming system 100 with a podium 102 located adjacent to a gaming table 104 according to the illustrated embodiment. The table 104 includes a front portion 106, a back portion 108, and a playing surface 109. In all the embodiments herein, optical readers 114 for reading encoded information on the wagers (e.g., casino chips) are located behind the back portion 108 of the gaming table 104. A series of virtual, vertically extending lines 110 in FIG. 4 outline the front portion 106 of the table 104 for clarity. The playing surface 109 is disposed between the front portion 106 and the back portion 108 of the table 12. In addition, a pad 112 is supported on the playing surface 109 of the gaming table 104 according to the illustrated embodiment.

The podium 102 includes an upper portion 103 that rises at least slightly above the playing surface 109 by a distance "T" so that optical readers 114 located in the upper portion 103 of the podium 102 have an adequate "line of sight" 122 (FIG. 5) with areas on the gaming table 104, such as the wagering areas described above.

Figure 5:
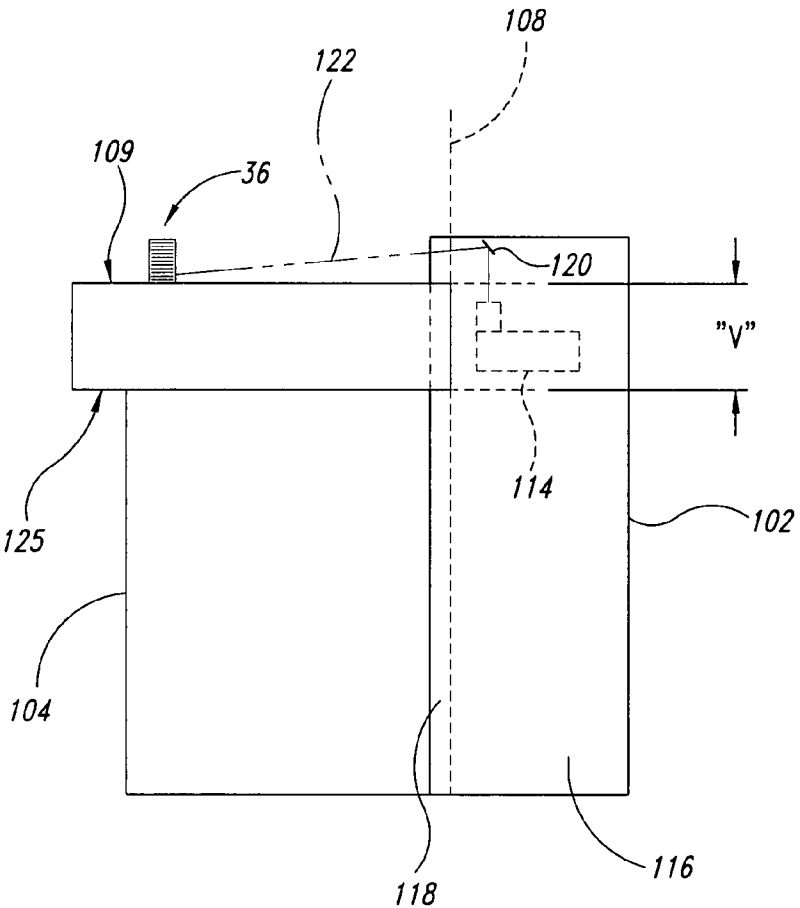
FIG. 5 is a cross-sectional view of a first portion of a podium behind a back portion of a gaming table and a second portion of the podium attached to the gaming table according to one illustrated embodiment.

FIG. 5 schematically shows a gaming table 104 and podium 102 abutted or otherwise attached together according to one illustrated embodiment. The podium 102 includes a first portion 116 and a second portion 118. The first portion 116 is positioned behind the back portion 108 of the gaming table 104, while the second portion 118 extends past the back portion 108 and toward the front portion 106. The second portion 118 can be an attachment device as illustrated in FIG. 6.

At least one optical reader 114, such as a camera for taking still or video images and/or a laser scanner, is carried by the first portion 116 of the podium 102. Thus, the optical reader 114 is also located behind the back portion 108 of the table 12.

In the illustrated embodiment of FIG. 5, for example, the optical reader 114 is located in the first portion 116 of the podium 102 and further located in a volume defined between the playing surface 109 and a lower surface 125 of the gaming table 104, which is depicted in two dimensions as volume "V." In this embodiment, a reflector/deflector 120 is located in the first portion 116 of the podium 102 above the surface 109 of the gaming table 104. The reflector/deflector 120 can be a moveable mirror, prism, or similar device that directs light emitted from the optical reader 114 toward a wager on the playing surface 109 and/or directs light reflected from the wager back to the optical reader 114.

Figure 6:
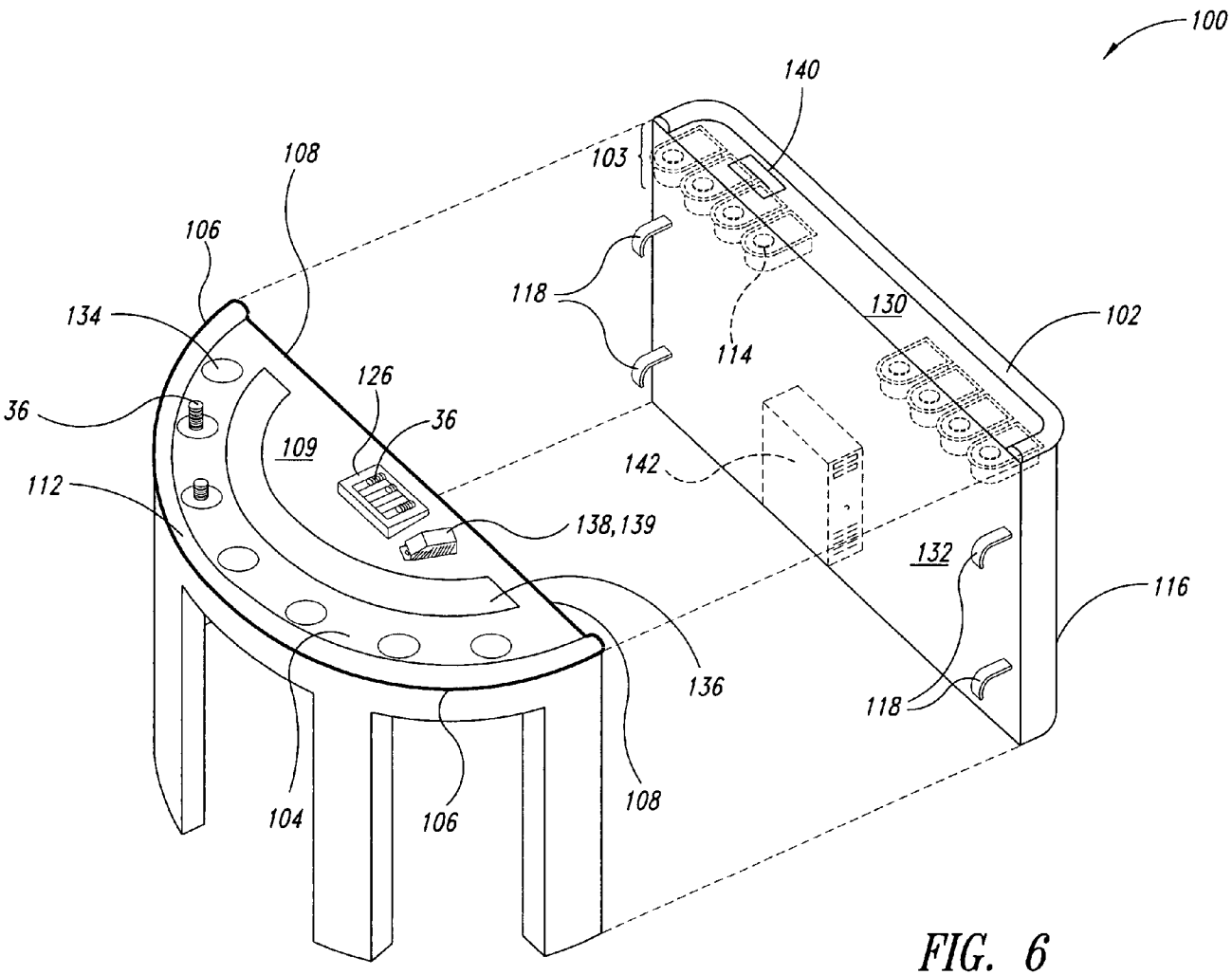
FIG. 6 is a top, front, right side, exploded, isometric view of a gaming table and podium according to another illustrated embodiment.

FIG. 6 shows a podium 102 with a first portion 116 and a second portion 118 abutted and/or attached to a gaming table 104 according to the illustrated embodiment of the gaming system 100. The second portion 118 of the podium 102 is a set of brackets that protrude into the gaming table 104 for attachment therewith. The podium 102 includes an upper surface 130 and a back surface 132. At least a portion of the back surface 132 can be, but is not required to be, complementarily shaped to match a profile of the back portion 108 of the gaming table 12.

The back surface 132 may be covered with felt to have a similar look and feel as the gaming table surface 124. A different material that permits the transfer of light from the optical readers 114 to the chips 36 can be used in lieu of felt in desired locations. It is generally desirable for the casinos to keep their game monitoring systems concealed. Thus, in one embodiment, the back surface 132, or at least the upper portion 103 of the back surface 132 that rises above the gaming table 104 is made from a light transmissive material. For example, darkened glass with a scratch resistant coating and that matches the coloring of the gaming table is used to conceal the optical readers 114 in one embodiment.

A drop box 140 is set into the podium 102. Additionally or alternatively, a computing device 142, for example a CPU, is located within a chamber formed in the podium 102 according to the illustrated embodiment.

The illustrated gaming table 104 includes the front portion 106, the back portion 108, and the playing surface 109 according to the description provided above. In addition, the gaming table 104 may include the padded rail 112. Betting circles 134, and/or secondary wagering areas 136 are carried by the playing surface 109.

A chip tray 126 and a card-dispensing device 138/139 are located on the gaming table surface 109. The position or location of any of the aforementioned devices on the gaming table 104 is for illustrative purposes only and does not limit the scope of the claimed invention. Electrical and/or data wiring (not shown) from the podium 102 to/from the table 104 can be provided under the table 104.

Figure 7:
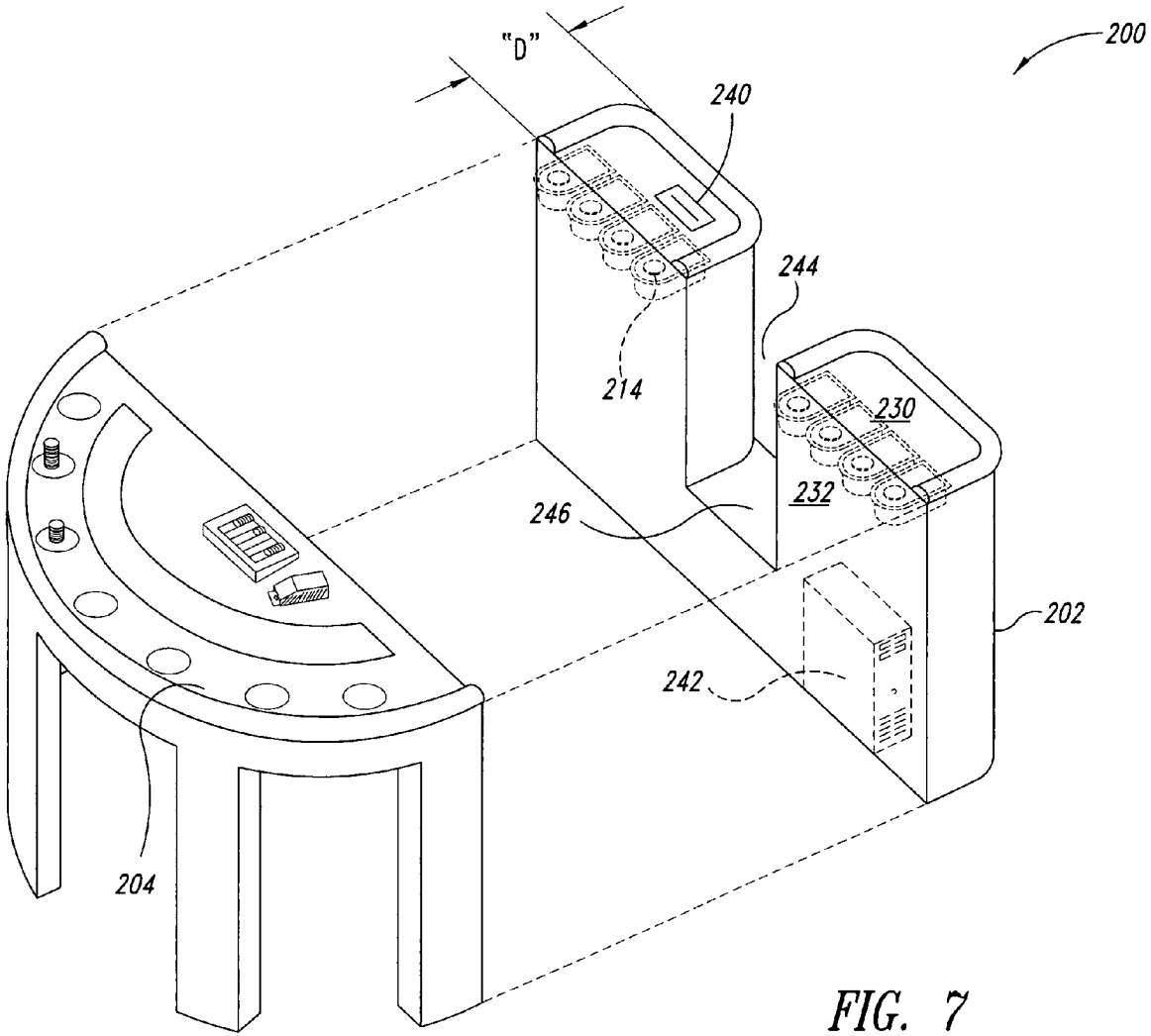
FIG. 7 is a top, front, right side, exploded, isometric view of a gaming table and a podium having an access region for a dealer according to one illustrated embodiment.

FIG. 7 shows a gaming system 200 having a gaming table 204 and a podium 202. The podium 202 is similar to the above embodiments in that it has an upper surface 230 and a back surface 232. A number of optical readers 214 are located in the podium 202. Further, a drop box 240 is recessed into the upper surface 230 of the podium 202 according to the illustrated embodiment.

The podium 202 has a width or depth "D" and a dealer's access region 244. The depth "D" of the podium 202 should is wide enough to allow the podium 102 to receive various automated components as described above, but not so wide that it adversely impacts a reach of the dealer, for example when the dealer attempts to collect or distribute chips 36, cards, or collect currency.

The dealer's access region 244 allows the podium 202 to have more depth "D," which in turn allows more or larger items to be located on the upper surface 230and/or within the podium 202, for example a drop box 240 carried by the upper surface 230 and a computing system 242 located within the podium 202. In addition, the dealer's access region 244 provides the dealer easier or less cumbersome access to the gaming table 204. The dealer's access region 244 can include a step 246 according to the illustrated embodiment. The step 246 can be separable or removable from the podium 202.

Figure 8:
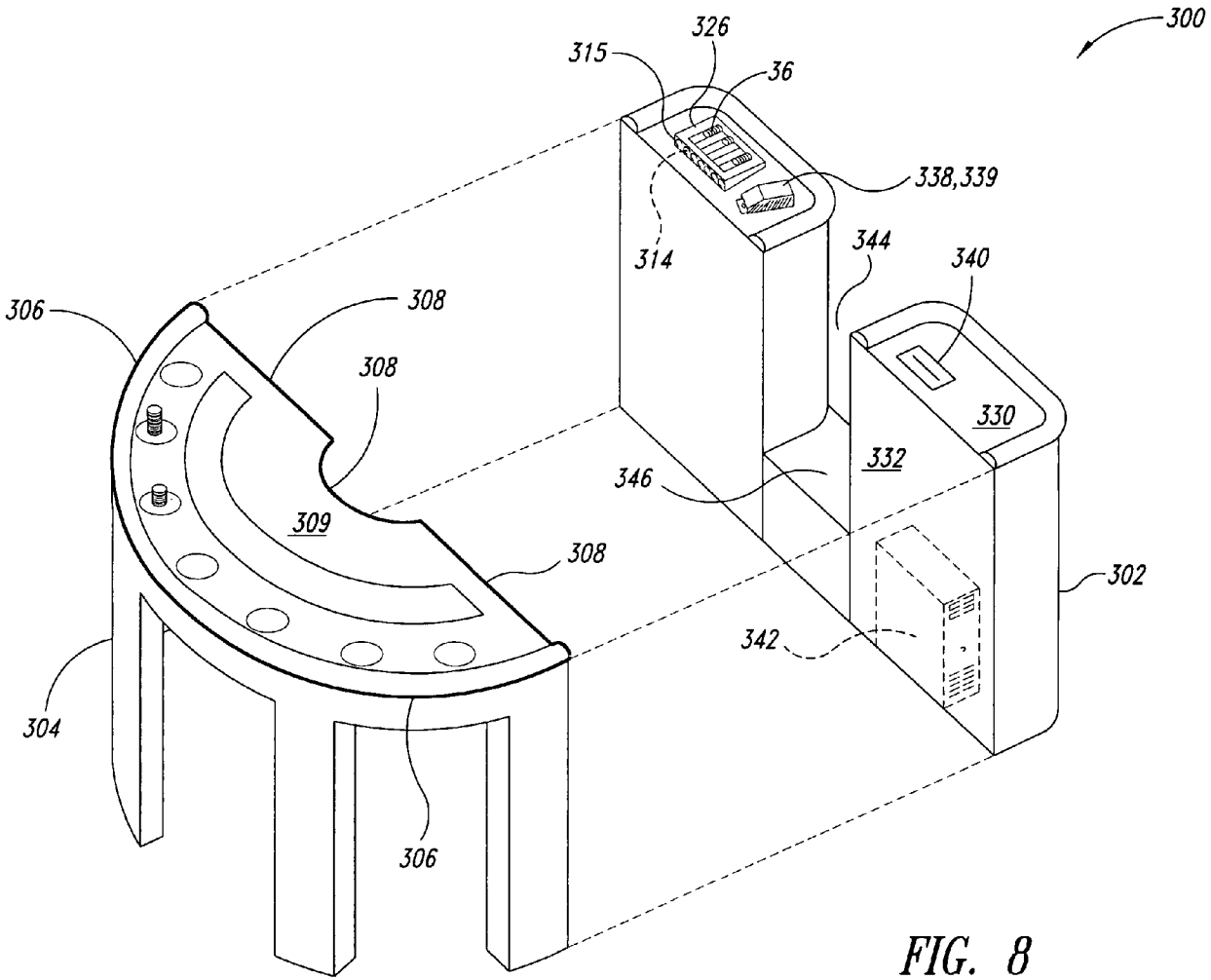
FIG. 8 is a top, front, right side, exploded, isometric view of a gaming table and a podium with full automation features according to one illustrated embodiment.

FIG. 8 shows a gaming system 300 having a gaming table 304 and a podium 302. The gaming table 304 includes a front portion 306, a back portion 308, and a playing surface 309. In the illustrated embodiment, the back portion 306 is formed with a profile that cooperates with a dealer's access region 344 in the podium 302.

The podium 302 includes an upper surface 330, a back surface 332, the dealer's access region 344, and a detachable step 346. In the illustrated embodiment, the podium 302 is supports or carries the majority of the gaming items such as a drop box 340, a card-dispensing device 328/329, and a chip tray 326. The chip tray 326 includes a number of optical readers 314 for reading chips 36 located on the gaming table 304. A foremost portion 327 of the chip tray 326 is located behind the back portion 308 of the gaming table 304. A computing system 342 is located within the podium 302 for communicating with the various items described above, for communicating with the casino's main computing system, or both.

The various embodiments described above can be combined to provide further embodiments. All of the above U.S. patents, patent applications, provisional patent applications and publications referred to in this specification, including, but not limited to, commonly assigned U.S. Provisional Patent Application No. 60/517,297; U.S. Pat. Nos. 6,460,848; 6,652,379; 6,685,568; U.S. Provisional Patent Application Nos. 60/500,898; 60/501,489; 60/511,931; 60/490,072; U.S. Pat. No. 6,712,696; and U.S. Provisional Patent Application No. 60/562,796 are incorporated herein by reference in their entirety. Aspects and/or embodiments described and/or incorporated by reference herein, to include features known by those skilled in the art, can be modified, if necessary, to create other systems, assemblies, devices, and/or concepts of the various patents, applications and publications to provide yet further aspects and/or embodiments.

These and other changes can be made in light of the above-detailed description. In general, in the following claims, the terms used should not be construed to limit the invention to the specific embodiments disclosed in the specification and the claims, but should be construed to include all game monitoring systems and methods that operate in accordance with the claims. Accordingly, the invention is not limited by the disclosure, but instead its scope is to be determined entirely by the following claims.

We claim:

1. A gaming table comprising:

a playing surface on which a card game may be played, the playing surface having a front portion about which a number of player positions are generally distributed, the playing positions demarcated on the playing surface by a number of wagering areas, and a back portion generally opposed across the playing surface from the front portion;

a dealer podium spaced behind and directly abutted against the back portion of the playing surface; and a reader carried by the dealer podium, the reader having at least one field of view extending generally toward at least one of the wagering areas.

2. The gaming table of claim 1 wherein the back portion includes two ends and the front portion includes two ends.

3. The gaming table of claim 2 wherein one end of the back portion is proximately located with one end of the front portion.

4. The gaming table of claim 1 wherein the front portion and the back portion form a perimeter about the playing surface.

5. The gaming table of claim 1 wherein the back portion of the playing surface includes a curved segment.

6. The gaming table of claim 1 wherein the back portion of the playing surface includes a stepped segment.

7. The gaming table of claim 1 wherein the reader carried by the dealer podium is an optical imager.

8. The gaming table of claim 1 wherein the reader carried by the dealer podium is an optical scanner.

9. The gaming table of claim 1 wherein the reader is located within a region of the podium that is below the playing surface and above a lower surface of the gaming table.

10. A gaming table comprising:

a perimeter region of the gaming table having a first portion and a second portion, the first portion of the perimeter region having a number of player positions distributed adjacently thereto and demarcated by a number of wagering areas, the second portion of the perimeter region permitting casino access to the gaming table;

a playing surface on which a card game may be played, the playing surface spaced generally between the first portion of the perimeter region and the second portion of the perimeter region;

at least a portion of a dealer podium spaced behind the second portion of the perimeter region of the gaming table; and at least one reader carried by the dealer podium and arranged to have a number of fields of view, wherein each respective wagering area is generally within at least one field of view that extends from the at least one reader over at least a respective portion of the playing surface generally toward the respective wagering area, the at least one reader configured to read at least one wager placed approximately within at least one of the number of wagering areas.

11. The gaming table of claim 10 wherein the first portion includes two ends and the second portion includes two ends.

12. The gaming table of claim 11 wherein one end of the first portion is proximately located with one end of the second portion.

13. The gaming table of claim 11 wherein one end of the first portion is spaced apart from one end of the second portion.

14. The gaming table of claim 10 wherein the at least a portion of the dealer podium spaced behind the second portion of the perimeter region of the gaming table includes the dealer podium abutted against the second portion of the perimeter region of the gaming table.

15. The gaming table of claim 10 wherein the at least a portion of the dealer podium spaced behind the second portion of the perimeter region of the gaming table includes the dealer podium attached to the second portion of the perimeter region of the gaming table.

16. The gaming table of claim 10 wherein the second portion of the perimeter region includes a curved segment.

17. The gaming table of claim 10 wherein the second portion of the perimeter region includes a stepped segment.

18. The gaming table of claim 10 wherein the at least one reader carried by the dealer podium is an optical imager.

19. The gaming table of claim 10 wherein the at least one reader carried by the dealer podium is an optical scanner.

20. The gaming table of claim 10 wherein the at least one reader is located within a region of the podium that is below the playing surface and above a lower surface of the gaming table.

21. The gaming table of claim 10 wherein the wager bears at least one machine-readable symbol.

22. The gaming table of claim 10 wherein the dealer podium has opposed first and second ends, the first and the second ends of the dealer podium are generally aligned with at least a segment of the second portion of the playing surface, wherein a dealer access region is generally located about a point between the first and the second ends of the dealer podium, and wherein the dealer podium and the playing surface are mutually arranged to permit a dealer positioned generally about the dealer access region to collect wagers placed in the wagering areas.

23. The gaming table of claim 22, further comprising:

a movable optical reflector carried by the dealer podium and disposed in at least one optical path of the at least one reader, the at least one optical path including an optical path extending from the first reader to a respective wagering area of the at least one wagering areas.

24. The gaming table of claim 22 wherein the at least one reader includes a first reader proximal to the first end of the dealer podium and distal from the second end of the dealer podium and at least a second reader carried by the dealer podium proximal to the second end of the dealer podium and distal to the first end of the dealer podium, and wherein the dealer access region is generally about a point between the first reader and the at least one second reader.

25. The gaming table of claim 24 wherein the dealer podium has a first portion and a second portion separated by a gap from the first portion, the first portion carrying the first reader and the second portion carrying the at least one second reader, the dealer access region generally within the gap separating the first portion and the second portion of the dealer podium.

26. The gaming table of claim 25 wherein the back portion of the playing surface includes a curved segment extending into the playing surface toward the first portion and generally aligned with the dealer access region.

27. A gaming system comprising:

a gaming table having a playing surface on which a card game may be played, the playing surface having a front portion about which a number of player positions are generally distributed, the playing positions demarcated on the playing surface by a number of wagering areas, and a back portion generally opposed across the playing surface from the front portion;

a moveable dealer podium positioned behind the gaming table proximate to the back portion of the playing surface and having opposed first and second ends with a dealer access region generally about a point interposing the first and the second ends of the dealer podium, the dealer access region permitting access to each one of the wagering areas by a person located generally proximal to the dealer access region; and at least one reader carried by the dealer podium, the at least one reader aligned with at least one wagering area of the number of wagering areas to have at least one field of view extending generally toward at the least one wagering area of the number of wagering areas, wherein each wagering area of the number of wagering areas is within at least one field of view of the at least one reader such that a respective wager placed generally within any one of the wagering areas is readable by the at least one reader.

28. The gaming system of claim 27, further comprising:

means for removably coupling the dealer podium to the gaming table.

29. The gaming system of claim 27 wherein the at least one reader includes a first reader proximal to the first end of the dealer podium and distal from the second end of the dealer podium and at least a second reader carried by the dealer podium proximal to the second end of the dealer podium and distal to the first end of the dealer podium, and wherein the dealer access region is generally about a point between the first reader and the at least one second reader.

30. The gaming system of claim 29 wherein the dealer podium has a first portion and a second portion separated by a gap from the first portion, the first portion carrying the first reader and the second portion carrying the at least one second reader, the dealer access region generally within the gap separating the first portion and the second portion of the dealer podium.

* * * * *

UNITED STATES PATENT AND TRADEMARK OFFICE

CERTIFICATE OF CORRECTION

PATENT NO. : 7,771,272 B2
APPLICATION NO. : 11/107411
DATED : August 10, 2010
INVENTOR(S) : Richard Soltys et al.

It is certified that error appears in the above-identified patent and that said Letters Patent is hereby corrected as shown below:

On the Title Page:

Item 56
--6,599,191 07/29/03 Breeding et al. 463/25-- has been omitted from the face of the patent.

Item 56
"5,651,548 A 7/1997 French et al. 463/25" should read, --5,651,548 A 7/1997 French et al. 273/309--.

Item 56
"2005/0059479 A1 3/2005 Soltys et al. 463/29" should read, --2005/0059479 A1 3/2005 Soltys et al. 463/25--.

Signed and Sealed this
Twenty-eighth Day of August, 2012

David J. Kappos

David J. Kappos
*Director of the United States Patent and Trademark Office*